United States Patent [19]

Kusumoto

[11] Patent Number: 4,908,671

[45] Date of Patent: Mar. 13, 1990

[54] CLEANING DEVICE FOR AN IMAGE RECORDER

[75] Inventor: Hiroshi Kusumoto, Tokyo, Japan

[73] Assignee: Ricoh Company, Ltd., Tokyo, Japan

[21] Appl. No.: 295,739

[22] Filed: Jan. 11, 1989

[30] Foreign Application Priority Data

Feb. 16, 1988 [JP] Japan ..... 63-18895[U]

[51] Int. Cl.[4] ..... G03G 21/00

[52] U.S. Cl. ..... 355/298; 118/652

[58] Field of Search ..... 118/652; 355/299, 298

[56] References Cited

U.S. PATENT DOCUMENTS

| | | | |
|---|---|---|---|
| 3,871,762 | 3/1975 | Van Der Vlasakker | 355/299 X |
| 4,032,229 | 6/1977 | Tani et al. | 118/652 X |
| 4,131,359 | 12/1978 | Honda | 355/299 X |

FOREIGN PATENT DOCUMENTS

| | | |
|---|---|---|
| 0155577 | 9/1982 | Japan . |
| 0111081 | 7/1983 | Japan . |
| 0064881 | 4/1984 | Japan . |
| 0239788 | 11/1985 | Japan . |

*Primary Examiner*—A. T. Grimley

*Assistant Examiner*—Robert Beatty

*Attorney, Agent, or Firm*—Oblon, Spivak, McClelland, Maier & Neustadt

[57] ABSTRACT

A cleaning device for use in a laser printer, electrophotographic copier, facsimile apparatus or similar image recorder and having a cleaning blade for removing toner remaining on a photoconductive drum of the image recorder. Stubs individually extend outward from lower portions of opposite ends of a toner collecting tank. The tank is rotatably supported through the stubs by a frame on which the drum is rotatably mounted. Retaining members are securely mounted on the frame so as to retain the tank in position when the latter is rotated toward the drum. A pair of holder support members are provided in upper portions of opposite ends of the tank to support pins engageable with the retaining members of the frame and a blade holder which holds the cleaning blade. While the pins extend outward away from each other from the outer surfaces of the holder support members, the blade holder is rotatably mounted on shafts which extend inward toward each other from the inner surfaces of the holder support members in alignment with the pins.

4 Claims, 5 Drawing Sheets

CLEANING DEVICE FOR AN IMAGE RECORDER

BACKGROUND OF THE INVENTION

The present invention relates to an image recorder implemented by an electrophotographic or an electrostatic recording procedure and, more particularly, to a cleaning device for such an image recorder in which a cleaning blade for removing remaining toner from a photoconductive element can be positioned relative to the photoconductive element with accuracy.

An electrophotographic copier, facsimile apparatus, laser printer or similar image recorder of the kind described includes an image carrier or photoconductive element for forming an electrostatic latent image thereon. After the latent image on the photoconductive element has been developed by toner, the resulting toner image is transferred to a paper. A prerequisite with this kind of image recorder is that toner remaining on the photoconductive element after the transfer of a toner image be removed. A cleaning device used to meet this requirement usually includes a cleaning blade and holds an operating edge of the blade in pressing contact with the surface of the photoconductive element during cleaning, whereby toner remaining on the photoconductive element is scraped off. In order that the edge of the cleaning blade may be accurately pressed against the surface of the photoconductive element with an adequate force, it is necessary to position the cleaning blade accurately relative to the photoconductive element.

A prior art cleaning device includes a tank for collecting the toner scraped off by the cleaning blade and which is rotatable about a shaft relative to a frame that supports the photoconductive element. The tank is provided with holder support members for supporting a blade holder which in turn holds the cleaning blade, and pins individually engageable with retaining members, which are securely mounted in predetermined portions of the frame, when the tank is rotated toward the photoconductive element until the edge of the cleaning blade assumes an accurate position relative to the photoconductive element in contact with the latter. The holder support members and the pins are provided in different portions of the tank.

With the prior art cleaning device described above, the force urging the operating edge of the cleaning blade against the photoconductive element cannot be maintained adequate and constant unless the various structural members, especially, holder support members mounted on the tank, pins and retaining members mounted on the frame, are positioned relative to each other with extreme accuracy. It is difficult, however, to assemble such members in their predetermined positions while accurately positioning them relative to each other. Further, the relative position is apt to be affected as the cleaning device is operated for a long period of time.

Thus, there is an increasing demand for a cleaning device whose cleaning blade can be positioned accurately and stably relative to a photoconductive element by maintaining various structural members in an accurate relative position and, yet, assembling the individual members in predetermined positions with ease.

SUMMARY OF THE INVENTION

It is therefore an object of the present invention to provide a cleaning device for an image recorder which enhances accurate positioning of a cleaning blade relative to a photoconductor element.

It is another object of the present invention to provide a generally improved cleaning device for an image recorder.

A cleaning device for use in an image recorder for removing toner which remains on a photoconductive element of the image recorder of the present invention comprises a tank for toner collection supported by a frame, which supports the photoconductive element, rotatably about stubs that are individually provided on opposite ends of the tank, a cleaning blade extending along an axis of the photoconductive element for scraping the remaining toner off the photoconductive element with an operating edge of the cleaning blade and thereby collecting the toner in the tank, a blade holder member holding the cleaning blade, a pair of holder support members individually securely mounted on the opposite ends of the tank and supporting opposite end portions of the blade holder member at inner surfaces of the holder support members rotatably about shafts which extend inward from the inner surfaces of the holder support members, and a pair of pins extending outward from outer surfaces of the holder support members in alignment with the shafts for, when the tank is rotated toward the photoconductive element, individual engaging with retaining members which are securely mounted on the frame member so as to retain the tank in position.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
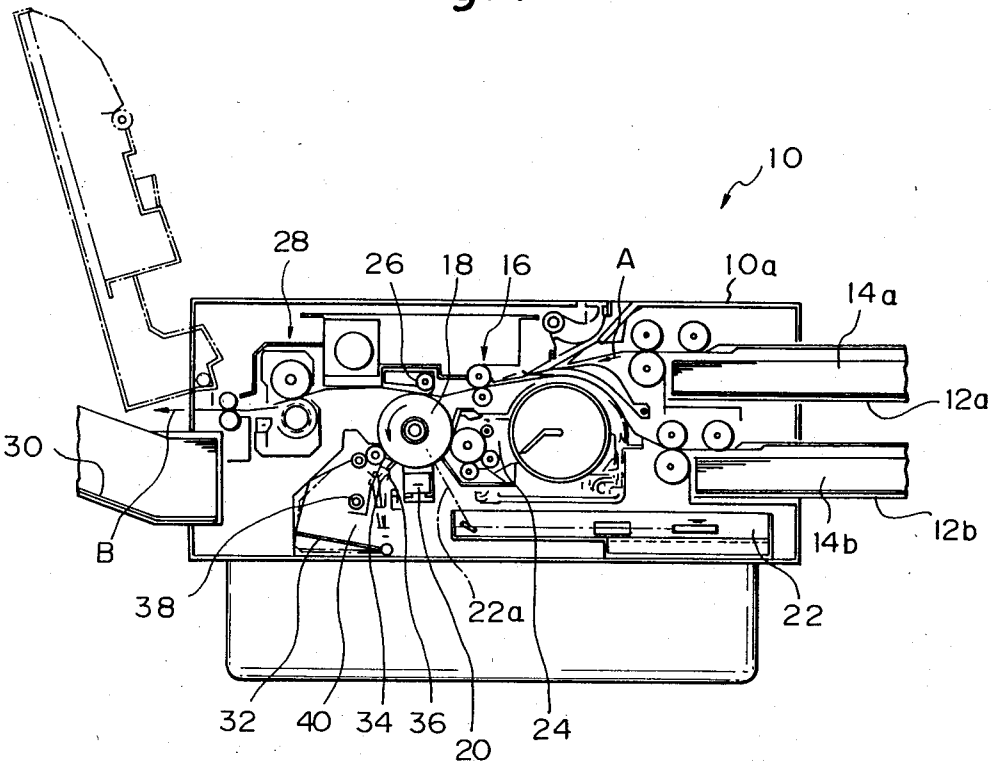
FIG. 1 is a sectional elevation of a laser printer belonging to a family of image recorders to which a present invention is applicable.
Figure 2:
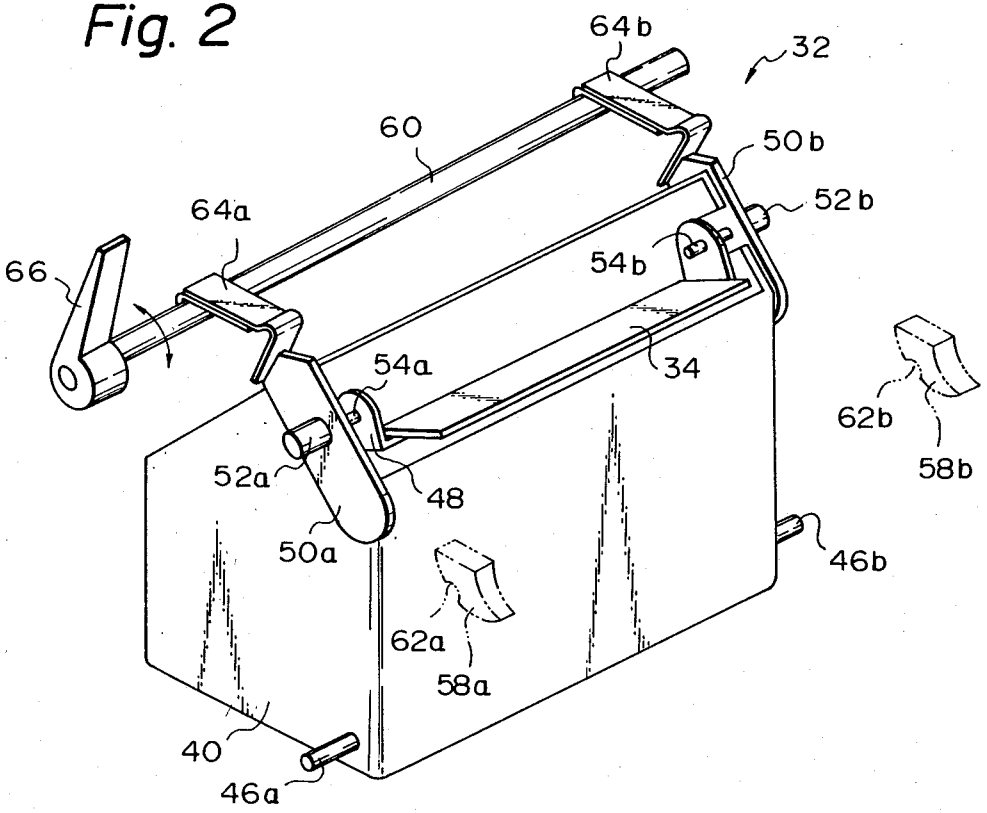
FIG. 2 is a perspective view of a cleaning device embodying the present invention.

Referring to FIG. 1 of the drawings, a laser printer representative of an image recorder to which the present invention is applicable is shown and generally designated by the reference numeral 10. As shown, the printer 10 includes a printer body 10*a* and paper cassettes 12*a* and 12*b* which are removably mounted in the printer body 10*a*. The paper cassettes 12*a* and 12*b* are loaded with paper sheets 14*a* and 14*b*, respectively. Any of the paper sheets 14*a* and 14*b* fed from the associated cassette 12*a* or 12*b* in a direction indicated by an arrow A is driven at a predetermined timing toward a photoconductive drum 18 by a register roller pair 16. While the drum 18 is rotated counterclockwise as indicated by an arrow in the figure, its surface is sequentially charged by a main charger 20. Imagewise light 22*a* from laser optics 22 is focused on the charged surface of the drum 18 to form an electrostatic latent image thereon. When the latent image is brought to a developing station where a developing device 24 is located, it is developed by a developer in the form of toner. The resulting toner image is transferred by a transfer charger 26 to the paper sheet which is transferred toward the drum 18 as stated above. The latent image on the paper sheet is fixed by a fixing device 28, and then the paper sheet is driven out of the printer body 10*a* forward a tray 30 as indicated by an arrow B in the figure.

After the transfer of the toner image, toner remaining on the drum 18 is removed by a cleaning blade 34 of a cleaning device 32. Then, a charge remaining on the drum 18 is dissipated by a discharging brush 36. The toner scraped off the drum surface is collected by a collecting roller 38 into a tank 40.

Figure 3:
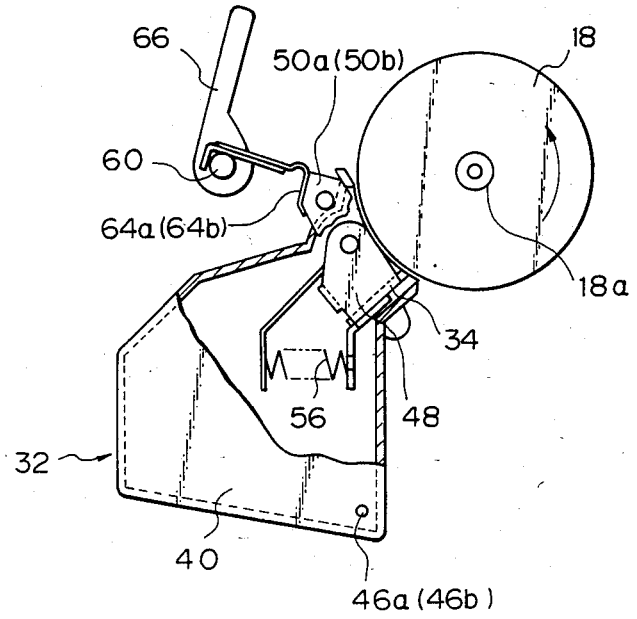
FIG. 3 is a side elevation showing a cleaning blade of the device shown in FIG. 2 which is pressed against a photoconductive drum.
Figure 4:
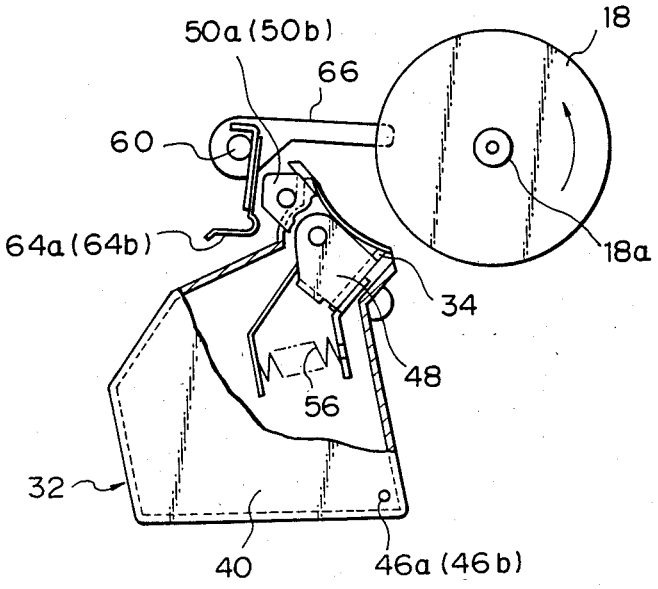
FIG. 4 is a view similar to FIG. 3, showing the cleaning blade in a position spaced apart from the photoconductive drum.
Figure 5:
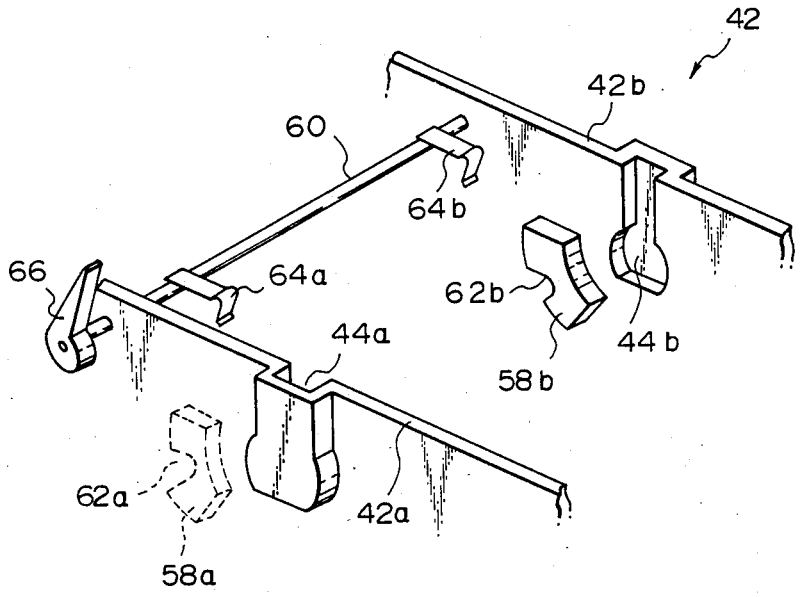
FIG. 5 is a fragmentary perspective view of a frame on which the drum and cleaning device are mounted.

Referring also to FIGS. 2, 3, 4 and 5, the drum 18 is mounted on a shaft 18*a* opposite ends of which are supported by a frame 42, as seen in FIG. 5. More specifically, the frame 42 includes drum receiving portions 44*a* and 44*b* in which the opposite ends of the shaft 18*a* are individually supported through bearings, not show. Stubs 46*a* and 46*b* extend outward from lower portions of opposite ends of the tank 40. The tank 40 is rotatably mounted on the frame 42 through the stubs 46*a* and 46*b*. Securely mounted in upper portions of the opposite ends of the tank 40 are holder members 50*a* and 50*b* which are adapted to support a blade holder 48, the cleaning blade 34 being held by the blade holder 48. Pins 52*a* and 52*b* are studded on the outer surfaces of the holder support members 50*a* and 50*b*, respectively. The blade holder 48 is rotatably mounted on the inner surfaces of the holder support members 50*a* and 50*b* through shafts 54*a* and 54*b*. The axes of the shafts 54*a* and 54*b* and the axes of the pins 52*a* and 52*b* are aligned with each other. A spring 56 constantly applies a predetermined biasing force to the blade holder 48.

The frame 42 includes a pair of retaining members 58*a* and 58*b* and a single shaft 60. The retaining members 58*a* and 58*b* are respectively securely mounted on parts 42*a* and 42*b* of the frame 42 and formed with generally semicircular recesses 62*a* and 62*b* for receiving the pins 52*a* and 52*b*. The shaft 60 is rotatably supported at its opposite ends by the parts 42*a* and 42*b* of the frame 42. Springs 64*a* and 64*b* are fitted on the shaft 60 for urging the holder support members 50*a* and 50*b*, respectively, as will be described. An operating lever 66 is provided on one end of the shaft 60 for rotating the shaft 60 as needed.

In the above construction, when the tank 40 is rotated about the stubs 46*a* and 46*b* from the position shown in FIG. 4 to the position shown in FIG. 3 where it adjoins the drum, the pins 52*a* and 52*b* mate with the recesses 62*a* and 62*b*, respectively. At this instant, the holder support members 50*a* and 50*b* are individually pressed by the springs 64*a* and 64*b* to in turn urge their associated pins 52*a* and 52*b* against the walls of the recesses 62*a* and 62*b*, whereby the tank 40 is retained in such a condition. At the same time, the edge of the cleaning blade 34 is pressed against the drum 18 by the spring 56. When the operating lever 66 is rotated, the shaft 60 is rotated to release the springs 64*a* and 64*b* from the holder support members 50*a* and 50*b*, as shown in FIG. 4. Then, the pins 52*a* and 52*b* are released from their associated recesses 62*a* and 62*b* to allow the tank 40 to be rotated about the stubs 46*a* and 46*b*.

In the position shown in FIG. 3, the holder support members 50*a* and 50*b* are accurately positioned by the retaining members 58*a* and 58*b*. Since the blade holder 48 is mounted on the holder support members 50*a* and 50*b* coaxially with the pins 52*a* and 52*b*, accurate positioning of the cleaning blade 34 relative to the drum 18 is guaranteed if the holder support members 50*a* and 50*b* and their associated retaining members 58*a* and 58*b* are accurately positioned relative to each other.

The springs 64*a* and 64*b* which press the holder support members 50*a* and 50*b*, respectively, offer the following advantage. Specifically, in many of the prior art cleaning devices, a toner collecting tank itself is pressed by such springs and therefore has to be provided with mechanical strength which withstands the pressure acting thereon. In contrast, the tank 40 of the illustrative embodiment needs only to withstand the weight of toner and therefore can be implemented as an inexpensive and light weight construction.

In summary, it will be seen that the present invention provides a cleaning device in which a cleaning blade can be accurately positioned relative to a photoconductive element only if holder support members provided on a tank of the device and retaining members provided on a frame which supports the device are positioned relative to each other with accuracy.

Various modifications will become possible for those skilled in the art after receiving the teachings of the present disclosure without departing from the scope thereof.

What is claimed is:

1. A cleaning device for use in an image recorder for removing toner which remains on a photoconductive element of said image recorder, comprising:

a tank for toner collection, said tank having stubs individually provided on opposite ends of said tank for supporting said tank on a frame which also supports a photoconductive element;

a cleaning blade positionable to extend along an axis of the photoconductive element and having an operating edge for scraping a remaining toner off the photoconductive element and thereby collecting the toner in said tank;

a blade holder member holding said cleaning blade;

a pair of holder support members individually securely mounted on the opposite ends of said tank and supporting opposite end portions of said blade holder member at inner surfaces of said holder support members, said blade holder member being rotatable about shafts which extend inward from the inner surfaces of said holder support members; and a pair of pins extending outward from outer surfaces of said holder support members and coaxially aligned with said shafts for, when said tank is rotated toward the photoconductive element, individually engaging with retaining members which are securely mounted on the frame so as to retain said tank in position, whereby said cleaning blade is accurately positioned relative to the photoconductive element by the coaxial alignment of said shafts and said pins.

2. A cleaning device as claimed in claim 1, further comprising biasing means for applying a predetermined biasing force to said blade holder member to urge the operating edge of said cleaning blade against said photoconductive element.

3. A cleaning device as claimed in claim 2, further comprising pin urging means for, when said tank is rotated toward said photoconductive element, urging said pins of said holder support members into engagement with said retaining members of said frame member.

4. A cleaning device as claimed in claim 3, wherein said pin urging means comprises a shaft member rotatably supported at opposite ends by said frame member, and pressing members fitted on said shaft member for individually pressing said holder support members.

* * * * *